US005953435A

United States Patent [19]

Mullin et al.

[11] Patent Number: 5,953,435

[45] Date of Patent: Sep. 14, 1999

[54] INTRA-CONCHA STABILIZER WITH LENGTH ADJUSTABLE CONCHAL WALL HOOK

[75] Inventors: James Mullin, Pleasanton; Kenneth Olson, Los Gatos; Petter Otto Schmidt, Campbell, all of Calif.

[73] Assignee: Hello Direct, Inc., San Jose, Calif.

[21] Appl. No.: 08/857,354

[22] Filed: May 16, 1997

[51] Int. Cl.[6] ..... H04R 25/00

[52] U.S. Cl. ..... 381/380; 381/328; 381/374

[58] Field of Search ..... 381/68, 68.2, 68.4, 381/68.5, 68.6, 69, 69.2, 312, 322, 324, 327, 328, FOR 126, FOR 133, FOR 140, FOR 150; 181/129, 130, 135; 379/430

[56] References Cited

U.S. PATENT DOCUMENTS

| | | | |
|---|---|---|---|
| 1,893,143 | 1/1933 | Koch | 381/169 |
| 1,953,437 | 4/1934 | Schier | 181/135 |
| 3,170,046 | 2/1965 | Leale | 179/107 |
| 4,668,842 | 5/1987 | Yokoyama et al. | 381/183 |
| 4,720,857 | 1/1988 | Burris et al. | 379/430 |
| 4,830,139 | 5/1989 | Cirillo | 181/130 |
| 4,965,838 | 10/1990 | Kamon et al. | 381/187 |
| 5,142,587 | 8/1992 | Kobayashi | 381/68.6 |
| 5,390,254 | 2/1995 | Adelman | 381/68 |
| 5,412,736 | 5/1995 | Keliiliki | 381/187 |

FOREIGN PATENT DOCUMENTS

| | | | |
|---|---|---|---|
| 3210034 | 9/1982 | Germany | H04R 1/10 |
| WO 95/30320 | 11/1995 | WIPO | H04R 1/10 |
| WO 96/02119 | 1/1996 | WIPO | H04R 1/10 |

*Primary Examiner*—Huyen Le
*Attorney, Agent, or Firm*—Haverstock & Owens LLP

[57] ABSTRACT

An intra-concha stabilizer with length adjustable conchal wall hook securely holds an audio transducer or speaker within a wearer's ear. The audio speaker is held within a support integrally included within an outer shell of the stabilizer. Within the outer shell, a conchal wall hook carrier slides along an integrally formed groove within the outside of the outer shell. The conchal wall hook perpendicularly protrudes away from the inside of the outer shell and the conchal wall hook carrier in order to engage the conchal wall of the wearer's ear. When worn, the audio speaker is positioned within the wearer's ear between the tragus and the antitragus. The conchal wall hook is then slidably positioned against the conchal wall of the wearer's ear in order to secure the speaker within the ear.

18 Claims, 2 Drawing Sheets

INTRA-CONCHA STABILIZER WITH LENGTH ADJUSTABLE CONCHAL WALL HOOK

FIELD OF THE INVENTION

The present invention relates to headsets used to position an audio transducer adjacent to a wearer's ear canal. More particularly, the present invention relates to intra-concha type headsets which hold and stabilize an audio transducer within the lower concha of the wearer's ear.

BACKGROUND OF THE INVENTION

Many different headset devices have been used to position and stabilize an audio transducer adjacent to a wearer's ear. The audio transducer or speaker is positioned adjacent to a wearer's ear in order to deliver audio communications to the wearer. Such devices are used for delivering radio, stereo, two-way and telephonic type communications to a wearer. In headsets used for telephonic or similar type communications, a microphone is also positioned in the vicinity of the wearer's mouth, usually by a tubular extension, voice tube or boom, for receiving the wearer's voice and transmitting it over a telecommunications line.

A common headset design for holding an audio speaker adjacent to a wearer's ear is the headband style headset which fits over the wearer's head and positions the audio transducer in front of the wearer's ear canal. This style headset normally includes a stiff metal band or other rigid type support which is weighted or otherwise balanced on the side opposite to the side holding the audio speaker to stabilize the headset on the wearer's head. If two audio speakers are included in a headband style headset, one on each side, then no weighting or balancing is necessary. Such a headset is typically heavy, mechanically complicated and for some wearer's, wearing a headband style headset for long periods of time is uncomfortable.

Conventional earbud concha style headsets position the audio transducer inside the lower concha of the ear, between the tragus and the anti-tragus. However, different ear shapes and sizes make it difficult for a single design to both fit a wearer's ear correctly and to stabilize the headset. Typically, the receiver will be held in place by a headband, as described above, or other mechanical devices or stabilizers.

An ear hook is an example of such a mechanical stabilizer which has been used to stabilize an audio transducer within or on a wearer's ear. An ear hook is a large semicircular component that fits around the top of the wearer's ear between the helix of the ear and the side of the wearer's head. The audio transducer is then attached to the body of the ear hook and held in the lower concha in front of the ear canal. The ear hook and certain configurations of headbands suffer from the disadvantage that they will interfere with the arms of the wearer's eyeglasses.

U.S. Pat. No. 5,142,587 to Kobayashi teaches an intra-concha type electroacoustic transducer for use with audio devices. A drawing of the device of Kobayashi, positioned within a wearer's ear, is illustrated in FIG. 1. In the device taught by Kobayashi, an electroacoustic transducer or speaker 10 positioned to oppose an entrance portion of the external auditory meatus YB of the wearer's ear. An auxiliary support 13 extends away from a housing holding the transducer 10 in a direction opposite to the entrance portion of the external auditory meatus YB. This auxiliary support 13 is hollow, includes a flexible cushion 14 and is of a size which is longer than the distance between the transducer 10 and the conchal wall. When positioned in the wearer's ear, the speaker 10 is positioned between the tragus YD and the antitragus YE. The auxiliary support 13 is then squeezed, bent or flexed to fit between the transducer 10 and the innerwall portion of the antihelix, or conchal wall, of the wearer's ear. The flexible cushion 14 of the auxiliary support 13 will rest up against the conchal wall of the wearer's ear as the auxiliary support 13 tries to expand to its full length, thereby extending pressure against both the conchal wall and the transducer 10. The housing and the transducer 10 are thereby held in position within the wearer's ear between the tragus YD and the antitragus YE.

Gabriele Bungardt et al. teach a concha headset stabilizer in PCT Application No. PCT/US95/05260 which was published on Nov. 9, 1995 as International Publication No. WO 95/30320. This concha headset stabilizer is illustrated in FIG. 2. The stabilizer includes a receiver or transducer attachment 11, a flexible and resilient support member 17 and a concha stabilizer pad 21. The transducer attachment 11 is a foam ear cushion that engages and covers the speaker 27 within the receiver. The receiver shown in FIG. 2 also includes a voice tube 30. The flexible and resilient support member 17 extends upward from the transducer attachment. The concha stabilizer pad 21 is positioned at the end of the flexible and resilient support member 17. The stabilizer support 17 is again of a size which is longer than the distance between the transducer 27 and the conchal wall of the wearer's ear.

When worn, the transducer attachment 11 and the speaker 27 are positioned into the lower concha of the wearer's ear, fitting into the intertragic notch, between the tragus and the antitragus. The stabilizer support, including the flexible and resilient support member 17 and the concha stabilizer pad 21, is then positioned to be in contact within the upper concha of the wearer's ear, below the antihelix. To achieve this position, the wearer flexes or bends the stabilizer support in order to fit the stabilizer support between the transducer attachment 11 and the conchal wall. The stabilizer pad 21 is positioned to rest up against the conchal wall, thereby extending pressure against both the conchal wall and the audio transducer 27, as it tries to resiliently return to its full length. In this manner, the stabilizer support provides pressure between the conchal wall and the receiver attachment in the lower concha, and thereby holds the speaker 27 within the wearer's ear.

For illustration purposes and to aid in the understanding of the placement of the respective devices of the prior art and the present invention, a typical human ear is illustrated in FIG. 3. The outer ear, or pinna is an irregularly concave cartilaginous member comprised of a number of eminences and depressions which give each ear a distinct shape and form. The helix 29 is the curved outer rim of the ear. Below the helix 29 is the antihelix 45. The antihelix 45 is a curved prominence which describes a curve around the concha, a deep cavity containing the entry to the ear canal 33. The concha is divided into two parts, the upper concha 43 and the lower concha 41, by the crux of the helix 31 which curves around the outside of the ear, and extends inwards at about the vertical midpoint of the ear. The upper concha 43 lies above the crux of the helix 31 and below the antihelix 45. The lower concha 41 lies below the crux of the helix 31 and surrounds the entry to the ear canal 33. A conchal wall 47 separates the concha from the antihelix 45. In front of the lower concha 41 and projecting backwards from the front of the ear is the tragus 35, a small semicircular prominence. Opposite the tragus 35 and separated from it by the deep curvature of the intertragic notch 37 is the antitragus 39. The intertragic notch 37 is formed between the tragus 35 and the antitragus 39.

What is needed is a comfortable mechanical support apparatus which supports an audio transducer positioned within the intertragic notch of the wearer's ear. What is further needed is comfortable rigid support apparatus which supports an audio transducer positioned within the intertragic notch of the wearer's ear and enhances the acoustic qualities of the audio transducer.

SUMMARY OF THE INVENTION

An intra-concha stabilizer with length adjustable conchal wall hook securely holds an audio transducer or speaker within a wearer's ear. The audio speaker is held within a support integrally included within an outer shell of the stabilizer. Within the outer shell, a conchal wall hook carrier slides along an integrally formed groove within the outside of the outer shell. The conchal wall hook perpendicularly protrudes away from the inside of the outer shell and the conchal wall hook carrier in order to engage the conchal wall of the wearer's ear. When worn, the audio speaker is positioned within the wearer's ear between the tragus and the antitragus. The conchal wall hook is then slidably positioned against the conchal wall of the wearer's ear in order to secure the speaker within the ear.

DETAILED DESCRIPTION OF THE PREFERRED EMBODIMENT

The intra-concha stabilizer with length adjustable conchal wall hook of the present invention holds an audio transducer or speaker and secures that speaker within a wearer's ear without the need for a headband or behind-the-ear hook. The audio speaker is held within a support integrally included within an outer shell of the stabilizer. Within the outer shell, a conchal wall hook carrier slides along a groove integrally formed within the outside of the outer shell. The conchal wall hook perpendicularly protrudes away from the inside of the outer shell and the conchal wall hook carrier, for positioning within the wearer's ear. When properly positioned, the conchal wall hook will engage the conchal wall of the wearer's ear and thereby comfortably secure the audio speaker within the wearer's ear.

Figure 1:
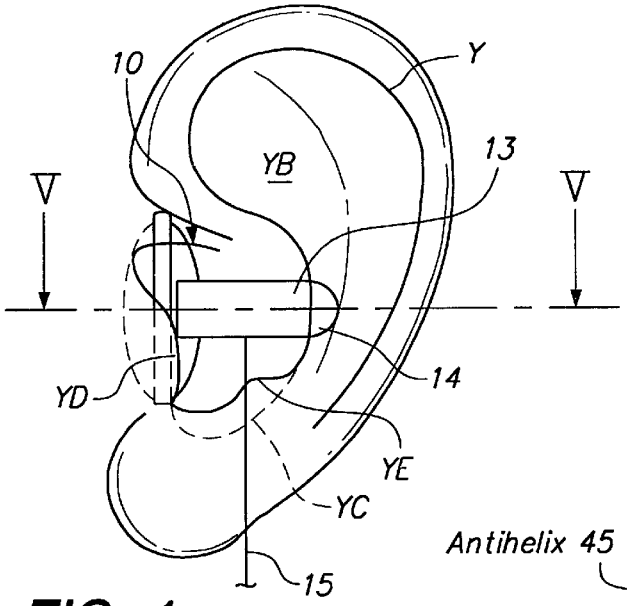
FIG. 1 (PRIOR ART)
FIG. 1 illustrates placement of an intra-concha type electroacoustic transducer of the prior art within a wearer's ear.
Figure 3:
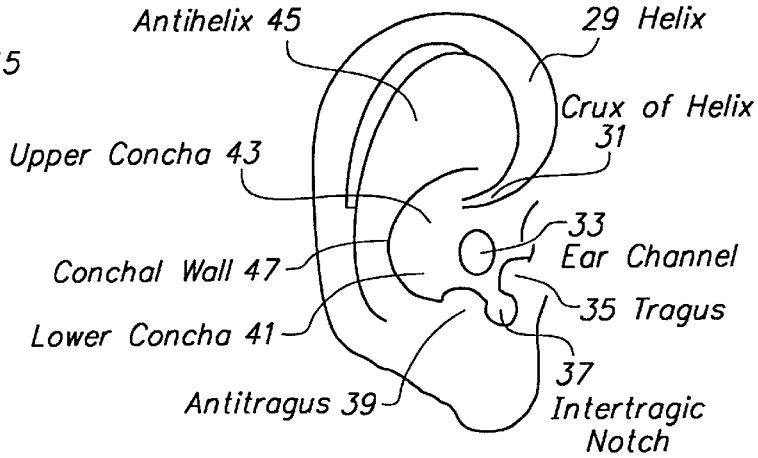
FIG. 3 illustrates relevant parts of a typical human ear.
Figure 2:
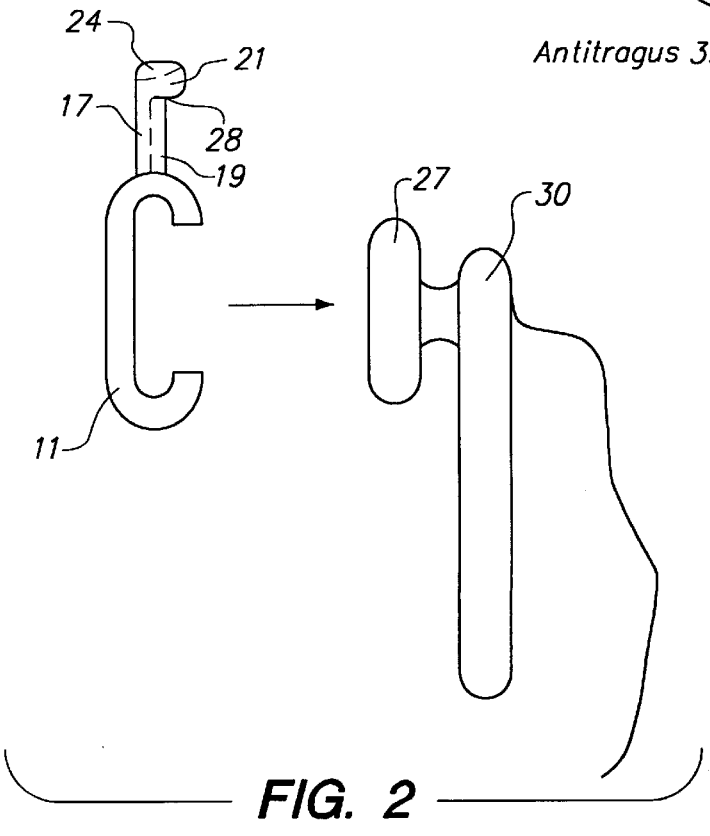
FIG. 2 (PRIOR ART)
FIG. 2 illustrates a concha headset stabilizer of the prior art.
Figure 4:
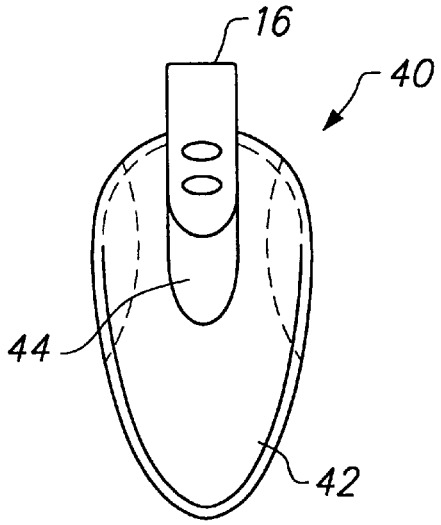
FIG. 4 illustrates the outside of the intra-concha stabilizer of the present invention.

The outside of the intra-concha stabilizer 40 of the present invention is illustrated in FIG. 4. An outer shell 42 includes a recessed groove 44. A conchal wall hook carrier 46 is slidably coupled to and slides within the groove 44 in the outer shell 42.

Figure 5:
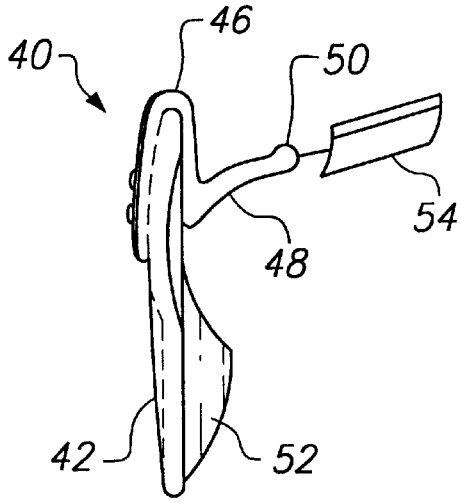
FIG. 5 illustrates a side view of the intra-concha stabilizer of the present invention.

A side view of the intra-concha stabilizer 40 of the present invention is illustrated in FIG. 5. The conchal wall hook carrier 46 supports the conchal wall hook 48. The conchal wall hook 48 is preferably rigid and includes an expanded tip 50 for engaging the conchal wall of the wearer's ear. A support 52 is included on the interior of the shell of the intra-concha stabilizer 40. The support 52 will receive and hold the casing and wire enclosure of the audio speaker, as will be described below. A polyester foam boot 54 fits over the conchal wall hook 48 to add to the comfort of the wearer when the conchal wall hook 48 is positioned against the conchal wall of the wearer's ear. Preferably, the shell 42, the conchal wall hook carrier 46 and the conchal wall hook 48 of the intra-concha stabilizer 40 are made of injection-molded plastic. However, as will be apparent to those skilled in the art, these parts can be formed from many other suitable materials. The conchal wall hook carrier 46 and the conchal wall hook 48 are preferably formed of an integral unit which slides within the groove 44. As also will be apparent to those skilled in the art, other configurations of the conchal wall hook carrier 46 and the conchal wall hook 48 are possible in order to achieve the objective of a slidable conchal wall hook which engages the conchal wall of the wearer's ear.

Figure 6:
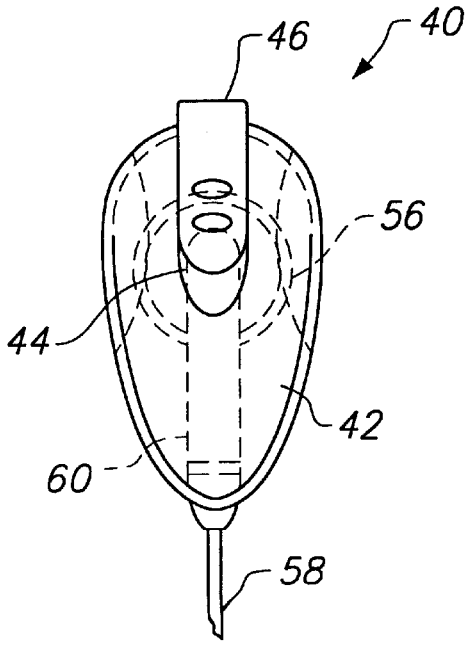
FIG. 6 illustrates the placement of an audio speaker within the intra-concha stabilizer of the present invention.
Figure 7:
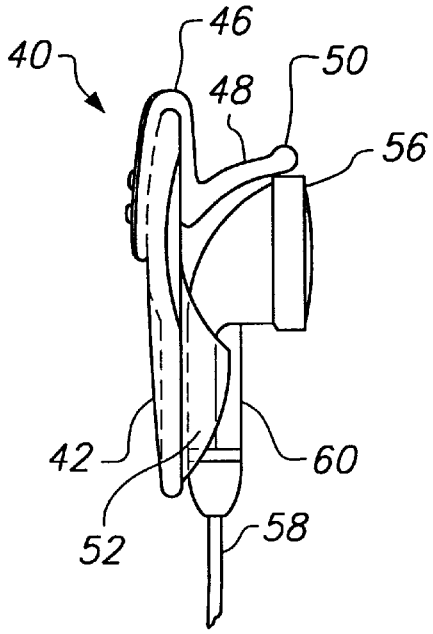
FIG. 7 illustrates a side view of the placement of an audio speaker within the intra-concha stabilizer of the present invention.

The positioning of an audio speaker 56 within the intra-concha stabilizer 40 of the present invention is illustrated in FIGS. 6 and 7. The casing 60, which holds the audio speaker 56, is fit into the support 52 which secures the audio speaker 56 to the stabilizer unit 40. FIG. 6 illustrates the placement of the audio speaker 56 within the intra-concha stabilizer 40. A side view of the intra-concha stabilizer 40 holding the audio speaker 56 is illustrated in FIG. 7.

The audio speaker 56 is coupled to a receiver or controller by the wire 58 which extends through the casing 60. In the preferred embodiment of the present invention, the speaker 56 is part of a telecommunications headset which includes a mechanically separate lapel microphone through which the wearer will communicate over the telecommunications line. However, as will be apparent to those skilled in the art, other configurations of the microphone are possible with the intra-concha stabilizer 40 of the present invention. Furthermore, the intra-concha stabilizer 40 of the present invention can also be used with audio speakers for devices other than a telecommunications headset.

When wearing the intra-concha stabilizer 40 of the present invention, the wearer will position the audio speaker 56 within their ear between the tragus and the antitragus. The wearer will then slide the conchal wall hook carrier 46. This action naturally also slides the conchal wall hook 48. This action is continued until the conchal wall hook 48 securely yet comfortably engages the conchal wall of the wearer's ear. The conchal wall hook carrier 46 is of a size to fit snugly into the groove 44 so that it will not slip or move without pressure being applied to it. In this manner, the audio speaker 56 is then securely and comfortably held within the wearer's ear, positioned between the tragus, the anti-tragus and the conchal wall. By positioning the conchal wall hook 48 securely against the conchal wall of the wearer's ear, the stabilizer 40 keeps the audio speaker 56 from moving within or falling from the wearer's ear and provides sufficient force to hold the audio speaker 56 against the lower concha of the wearer's ear.

The stabilizer 40 allows the audio speaker 56 to be comfortably worn by wearers having ears of different shapes and sizes. The intra-concha stabilizer 40 of the present invention will also fit into either the left or right ear of a wearer without any reconfiguration. The outer shell 42 adds a further advantage to the intra-concha stabilizer 40 because it will improve the audio characteristics of the system by excluding external sounds from the ear and providing an enhanced resonating acoustic chamber. This exclusion of external sounds will enhance the performance of the audio speaker 56 in a noisy environment.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

We claim:

1. An intra-concha stabilizer for securely holding an audio speaker in a wearer's ear, wherein the wearer's ear is either one of a right ear and a left ear, the audio speaker positioned between a tragus and an antitragus of the wearer's ear, comprising:

a. means for holding the audio speaker; and b. means for securely stabilizing slidably coupled to the means for holding for engaging a conchal wall of the wearer's ear and thereby stabilizing the audio speaker within the wearer's ear, wherein the means for securely stabilizing linearly slides relative to the means for holding in order to properly engage the conchal wall, wherein the stabilizer is configured to engage either one of the right ear and the left ear without further modification involving an interchanging of the means for securely stabilizing relative to the means for holding.

2. The intra-concha stabilizer as claimed in claim 1 wherein the means for holding includes an outer shell which surrounds the audio speaker within the wearer's ear.

3. The intra-concha stabilizer as claimed in claim 2 wherein the outer shell is of a size which excludes external sounds and provides an enhanced resonating acoustic chamber.

4. The intra-concha stabilizer as claimed in claim 2 wherein the means for securely stabilizing includes a conchal wall hook and a conchal wall hook carrier.

5. The intra-concha stabilizer as claimed in claim 4 wherein the conchal wall hook carrier slides within a groove formed integrally within the outer shell.

6. The intra-concha stabilizer as claimed in claim 5 further comprising a protective padding attached to the conchal wall hook for providing a comfortable feel to the wearer of the intra-concha stabilizer.

7. An intra-concha stabilizer for securely holding an audio speaker in wearer's ear, wherein the wearer's ear is either one of a right ear and a left ear, the audio speaker positioned between a tragus and an antitragus of the wearer's ear, comprising:

a. a support structure for holding the audio speaker; and b. a stabilizing structure slidably coupled to the support structure for stabilizing the audio speaker within the wearer's ear by engaging a conchal wall of the wearer's ear, wherein the stabilizing structure linearly slides relative to the support structure in order to properly engage the conchal wall, wherein the stabilizer is configured to engage either one of the right ear and the left ear without further modification involving an interchanging of the stabilizing structure relative to the support structure.

8. The intra-concha stabilizer as claimed in claim 7 wherein the support structure includes an outer shell which surrounds the audio speaker within the wearer's ear.

9. The intra-concha stabilizer as claimed in claim 8 wherein the outer shell is of a size which excludes external sounds and provides an enhanced resonating acoustic chamber.

10. The intra-concha stabilizer as claimed in claim 8 wherein the stabilizing structure includes a conchal wall hook and a conchal wall hook carrier.

11. The intra-concha stabilizer as claimed in claim 10 wherein the conchal wall hook carrier slides within a groove formed integrally within the outer shell.

12. The intra-concha stabilizer as claimed in claim 11 further comprising a protective padding attached to the conchal wall hook for providing a comfortable feel to the wearer of the intra-concha stabilizer.

13. An intra-concha audio speaker and stabilizing device comprising:

a. an audio speaker configured for positioning between a tragus and an antitragus of a wearer's ear, wherein the wearer's ear is either one of a right ear and a left ear;

b. a support structure configured for holding the audio speaker, including an outer shell which surrounds the audio speaker when the support structure holds the audio speaker, wherein the outer shell includes an integrally formed groove; and c. a stabilizing structure slidably coupled to the support structure for stabilizing the audio speaker within the wearer's ear, wherein the stabilizing structure includes a conchal wall hook and a conchal wall hook carrier which linearly slides within the integrally formed groove and carries the conchal wall hook to properly engage the conchal wall, further wherein the stabilizing structure is configured for engaging either one of the right ear and the left ear without further modification involving an interchanging of the stabilizing structure relative to the support structure.

14. The intra-concha audio speaker and stabilizing device as claimed in claim 13 wherein the outer shell is of a size to exclude external sounds and provide an enhanced resonating acoustic chamber.

15. The intra-concha audio speaker and stabilizing device as claimed in claim 14 further comprising a protective padding attached to the conchal wall hook for providing a comfortable feel to the wearer of the intra-concha stabilizer.

16. An intra-concha stabilizer for securely holding an audio speaker in a wearer's ear, wherein the wearer's ear is either one of a right ear and a left ear, the audio speaker positioned between a tragus and an antitragus of the wearer's ear, comprising:

a. means for holding the audio speaker; and b. means for securely stabilizing slidably coupled to the means for holding for engaging a conchal wall of the wearer's ear and thereby stabilizing the audio speaker within the wearer's ear, wherein the means for securely stabilizing linearly slides relative to the means for holding in order to properly engage the conchal wall, wherein the stabilizer is configured to engage either one of the right ear and the left ear without further modification.

17. intra-concha stabilizer for securely holding an audio speaker in wearer's ear, wherein the wearer's ear is either one of a right ear and a left ear, the audio speaker positioned between a tragus and an antitragus of the wearer's ear, comprising:

a. a support structure for holding the audio speaker; and b. a stabilizing structure slidably coupled to the support structure for stabilizing the audio speaker within the wearer's ear by engaging a conchal wall of the wearer's ear, wherein the stabilizing structure linearly slides relative to the support structure in order to properly engage the conchal wall, wherein the stabilizer is configured to engage either one of the right ear and the left ear without further modification involving an interchanging of the stabilizing structure relative to the support structure.

18. An intra-concha audio speaker and stabilizing device comprising:

a. an audio speaker configured for positioning between a tragus and an antitragus of a wearer's ear, wherein the wearer's ear is either one of a right ear and a left ear;

b. a support structure configured for holding the audio speaker, including an outer shell which surrounds the audio speaker when the support structure holds the audio speaker, wherein the outer shell includes an integrally formed groove; and c. a stabilizing structure slidably coupled to the support structure for stabilizing the audio speaker within the wearer's ear, wherein the stabilizing structure includes a conchal wall hook and a conchal wall hook carrier which linearly slides within the integrally formed groove and carries the conchal wall hook to properly engage the conchal wall, further wherein the stabilizing structure is configured for engaging either one of the right ear and the left ear without further modification.

* * * * *

UNITED STATES PATENT AND TRADEMARK OFFICE

CERTIFICATE OF CORRECTION

PATENT NO. : 5,953,435

DATED : Sept. 14, 1999

INVENTOR(S) : James Mullin et al.

It is certified that error appears in the above-identified patent and that said Letters Patent is hereby correct as shown below:

In column 6, line 59, insert --An-- before "intra-concha".

Signed and Sealed this

Seventh Day of March, 2000

*Attest:*

*Attesting Officer*

Q. TODD DICKINSON

*Commissioner of Patents and Trademarks*